US006974398B2

(12) United States Patent
Murphy

(10) Patent No.: US 6,974,398 B2
(45) Date of Patent: Dec. 13, 2005

(54) MAGNUM BULLET DARTS

(75) Inventor: Steven Curtis Murphy, 23893 Bay Ave., Apt. #113, Moreno Valley, CA (US) 92553

(73) Assignee: Steven Curtis Murphy, Moreno Valley, CA (US)

( * ) Notice: Subject to any disclaimer, the term of this patent is extended or adjusted under 35 U.S.C. 154(b) by 82 days.

(21) Appl. No.: 10/452,344

(22) Filed: Jun. 2, 2003

(65) Prior Publication Data

US 2005/0227796 A1 Oct. 13, 2005

Related U.S. Application Data

(60) Provisional application No. 60/386,674, filed on Jun. 6, 2002.

(51) Int. Cl.[7] ..... A63B 65/02
(52) U.S. Cl. ..... 473/578
(58) Field of Search ..... 473/578, 582, 473/585, 586

(56) References Cited

U.S. PATENT DOCUMENTS

| | | | | |
|---|---|---|---|---|
| 5,009,433 A * | 4/1991 | Reid | 473/582 |
| 5,375,850 A * | 12/1994 | Pickett | 473/585 |
| 5,895,331 A * | 4/1999 | Rinehart | 473/578 |
| 5,947,851 A * | 9/1999 | Kicks et al. | 473/582 |
| 6,277,041 B1 * | 8/2001 | Fenn | 473/578 |

* cited by examiner

*Primary Examiner*—John A. Ricci

(57) ABSTRACT

The Magnum Bullet Dart is a throwing dart which includes a body made from a firearm bullet cartridge of any automatic, semi-automatic, small or large caliber, magnum or regular types. In a first embodiment, a steel point extends from the front of the bullet casing, and a flight shaft of fixed length is attached to the rear of the bullet casing. A user can remove the shaft, and insert or remove weighting material, such as lead shot, into or out of the cartridge through the hole, to adjust the weight of the dart. In a second embodiment, a steel point extends from the front of the bullet casing, and a flight shaft is slidably mounted through a hole in the rear of the casing; the length of the shaft extending rearward of the casing may be adjusted according to the preference of the user. This adjustability does not require the dart owner to purchase different lengths of shafts, thus adding convenience and saving money.

1 Claim, 1 Drawing Sheet

Figure 1
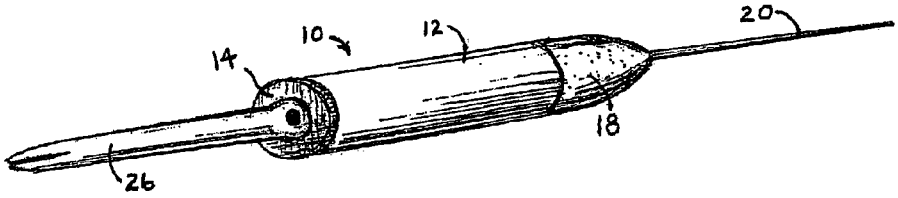
Figure 2
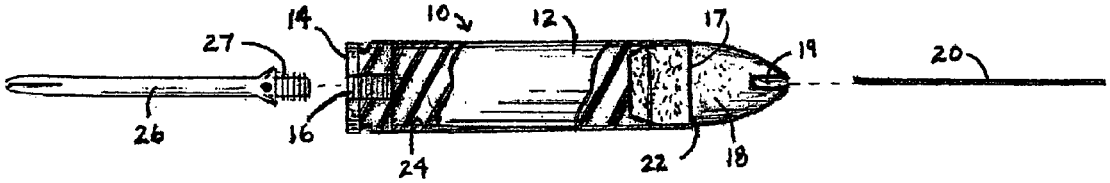
Figure 3
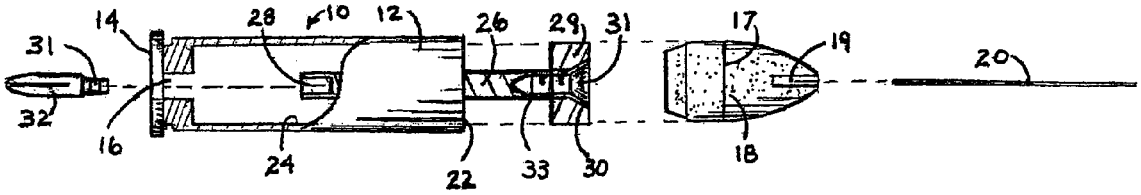
Figure 4
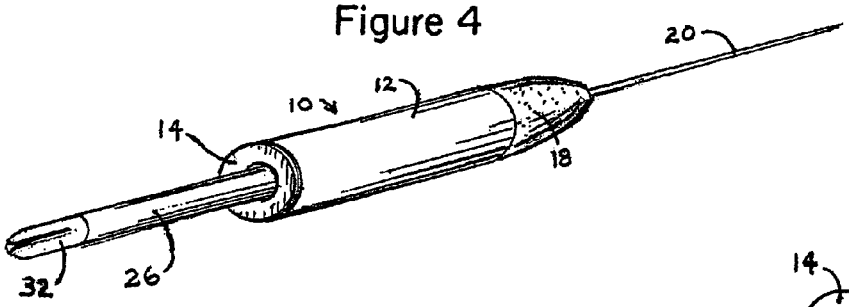
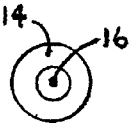
Figure 5

MAGNUM BULLET DARTS

This application claims the benefit of Provisional Application Ser. No. 60/386,674, filed Jun. 6, 2002.

BRIEF SUMMARY OF THE INVENTION

My invention, the Magnum Bullet Darts, are a new and unique type of throwing dart which includes a body made from a firearm bullet cartridge. They may be constructed of actual firearm cartridge components of all types and size, for example a 0.357 Magnum bullet, or any automatic, semi-automatic, small or large caliber, magnum or regular types. In a first embodiment, a steel point extends from the front of the bullet casing, and a flight shaft of fixed length is attached to the rear of the bullet casing, which may be by means of a threaded through hole. A user can remove the shaft, and insert or remove weighting material, such as lead shot, into or out of the cartridge through the hole, to adjust the weight of the dart. In a second embodiment, a steel point extends from the front of the bullet casing, and a flight shaft is slidably mounted through a hole in the rear of the casing; the length of the shaft extending rearward of the casing may be adjusted according to the preference of the user. This adjustability does not require the dart owner to purchase different lengths of shafts, thus adding convenience and saving money.

BRIEF DESCRIPTION OF THE DRAWINGS

FIG. 1 is a perspective view of a 30 caliber dart, with a fixed shaft length;

FIG. 2 is an exploded plan view, partly in section, of the dart of FIG. 1;

FIG. 3 is an exploded plan view, partly in section, of a dart with adjustable shaft length;

FIG. 4 is a perspective view of the dart of FIG. 3;

FIG. 5 is a rear view of the dart, with the flight shaft removed.

DETAILED DESCRIPTION OF THE INVENTION

A first preferred embodiment of the invention 10 is illustrated in FIGS. 1 and 2. The dart includes a cartridge 12, for example a 30 caliber cartridge. A hole 16 is drilled through the rear wall 14 and threaded. A flight shaft 26 is attached to the rear wall by means of threads 27. A full metal jacketed bullet 18 is then inserted into the front 22 of the cartridge 12 so that it engages interior walls 24 of the cartridge, until bullet seat line 17 meets front opening 22. A hole 19, which may be 1/16 inch diameter and 4 inch deep, is drilled into the front of the bullet. A point rod 20, which may be 1/16 inch spring steel rod, 1½ inches long, is engaged into hole 19, and may be retained with adhesive such as "super glue". The front of point 20 may be sharpened. A user may unscrew the shaft 26 from the cartridge 12, and insert or remove weighing material such as lead shot (not shown) through hole 16 to adjust the weight of the dart, and reattach shaft 26 and cartridge 12.

A second preferred embodiment of the invention 10 is illustrated in FIGS. 3 and 4. The dart includes a cartridge 12, for example a 0.357 magnum cartridge made of brass or nickel. A hole 16 is drilled through the rear wall 14, for example using a ¼ inch drill bit. The flight shaft 26 may be a plastic tube of ¼ inch outer diameter and ⅛ inch inside diameter, as shown at 33, and a length of 1⅝ inches. A plastic plug 29, which may be 3/16 inch thick, has a ⅛ inch hole drilled through its center, which may be beveled as shown at 30. The plug 29 is attached to the end of shaft 26 by means of screw 31, which may be ⅝ inch long and bevel headed. The shaft-plug assembly is slid inside the cartridge 12 so that the end extends through hole 16 for a desired distance and is held by friction between plug 29 and walls 24. Flight holder 32 is attached to the shaft by means of prong 31 extending into socket 28. A full metal jacketed bullet 18, for example a 0.357 magnum, is then inserted into the front 22 of the cartridge 12 so that it engages interior walls 24 of the cartridge, until bullet seat line 17 meets front opening 22. A hole 19, which may be 1/16 inch diameter and ¼ inch deep, is drilled into the front of the bullet. A point rod 20, which may be 1/16 inch spring steel rod, 1½ inches long, is engaged into hole 19, and may be retained with adhesive such as "super glue". The front of point 20 may be sharpened.

What is claimed is:

1. A dart, comprising a hollow casing, which may be a firearm cartridge casing, having a first open end, and a second end having a wall, and a hole drilled through the wall; an elongated shaft having a threaded hole extending into a first end, and a non-threaded hole extending into a second end; a plug attached to the first end of the shaft by means of a screw passing through the plug and threaded into the hole at the first end; the shaft being inserted through the first open end of the casing and through the hole in the wall at the second end of the casing, and the plug frictionally contacting the interior of the casing, so that the length of the shaft that extends through the hole in the wall can be adjusted; a flight holder frictionally inserted into the hole at the second end of the shaft; a solid bullet inserted into the first end of the casing and frictionally held so that a portion of the bullet extends out beyond the casing; a hole drilled into the outwardly extending portion of the bullet, and a point rod inserted into the hole of the bullet.

* * * * *